US009329542B2

(12) United States Patent
Arai et al.

(10) Patent No.: US 9,329,542 B2
(45) Date of Patent: May 3, 2016

(54) FIXING DEVICE AND IMAGE FORMING APPARATUS

(71) Applicants: Yuji Arai, Kanagawa (JP); Yoshio Hattori, Kanagawa (JP); Kazuya Saito, Kanagawa (JP); Hiroshi Yoshinaga, Chiba (JP); Shuntaro Tamaki, Kanagawa (JP)

(72) Inventors: Yuji Arai, Kanagawa (JP); Yoshio Hattori, Kanagawa (JP); Kazuya Saito, Kanagawa (JP); Hiroshi Yoshinaga, Chiba (JP); Shuntaro Tamaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/494,060

(22) Filed: Sep. 23, 2014

(65) Prior Publication Data

US 2015/0098738 A1 Apr. 9, 2015

(30) Foreign Application Priority Data

Oct. 7, 2013 (JP) ..... 2013-210095

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
USPC ..... 399/329
See application file for complete search history.

(56) References Cited

U.S. PATENT DOCUMENTS

2006/0285893 A1* 12/2006 Ishii ..... 399/329
2007/0292175 A1 12/2007 Shinshi
2011/0058864 A1 3/2011 Fujimoto et al.
2011/0064443 A1 3/2011 Iwaya et al.
2011/0085832 A1 4/2011 Hasegawa et al.
2011/0164905 A1* 7/2011 Kondo ..... G03G 15/2053 399/328
2011/0182634 A1 7/2011 Ishigaya et al.
2011/0200368 A1 8/2011 Yamaguchi et al.
2011/0217093 A1 9/2011 Tokuda et al.
2011/0222888 A1 9/2011 Ikebuchi et al.
2011/0222930 A1 9/2011 Fujimoto et al.
2011/0229181 A1 9/2011 Iwaya et al.
2011/0229225 A1 9/2011 Ishii et al.
2011/0229226 A1 9/2011 Tokuda et al.
2011/0229227 A1 9/2011 Yoshikawa et al.
2011/0274453 A1 11/2011 Shimokawa et al.
2011/0286758 A1 11/2011 Yoshinaga
2012/0045226 A1 2/2012 Hase et al.

(Continued)

FOREIGN PATENT DOCUMENTS

JP 2007-334205 12/2007
JP 2009-042305 2/2009
JP 2013-164473 8/2013

OTHER PUBLICATIONS

U.S. Appl. No. 14/277,477, filed May 14, 2014, Shimokawa, et al.

(Continued)

*Primary Examiner* — Minh Phan
(74) *Attorney, Agent, or Firm* — Oblon McClelland, Maier & Neustadt, L.L.P.

(57) ABSTRACT

A fixing device includes a fixing rotator rotatable in a predetermined direction of rotation and a pressure rotator pressed against an outer circumferential surface of the fixing rotator. A heater is disposed opposite an inner circumferential surface of the fixing rotator to heat the fixing rotator. A reflector is disposed opposite the heater to reflect light radiated from the heater onto the inner circumferential surface of the fixing rotator. A support mounts the reflector. A heater holder is mounted on the support to hold the heater.

15 Claims, 8 Drawing Sheets

(56) References Cited

U.S. PATENT DOCUMENTS

| | | | | |
|---|---|---|---|---|
| 2012/0121303 | A1 | 5/2012 | Takagi et al. | |
| 2012/0121304 | A1 | 5/2012 | Tokuda et al. | |
| 2012/0121305 | A1 | 5/2012 | Yoshikawa et al. | |
| 2012/0148303 | A1 * | 6/2012 | Yamaguchi et al. | 399/122 |
| 2012/0155935 | A1 | 6/2012 | Yoshikawa et al. | |
| 2012/0177388 | A1 | 7/2012 | Imada et al. | |
| 2012/0177420 | A1 | 7/2012 | Shimokawa et al. | |
| 2013/0164059 | A1 | 6/2013 | Takagi et al. | |
| 2013/0170879 | A1 | 7/2013 | Yoshinaga et al. | |
| 2013/0183071 | A1 | 7/2013 | Iwaya et al. | |
| 2013/0183072 | A1 | 7/2013 | Hase et al. | |
| 2013/0209147 | A1 | 8/2013 | Ogawa et al. | |
| 2014/0016971 | A1 | 1/2014 | Arai et al. | |

OTHER PUBLICATIONS

U.S. Appl. No. 14/278,252, filed May 15, 2014, Shimokawa, et al.
U.S. Appl. No. 14/277,477, filed May 14, 2014.

* cited by examiner

FIXING DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2013-210095, filed on Oct. 7, 2013, in the Japanese Patent Office, the entire disclosure of which is hereby incorporated by reference herein.

BACKGROUND

1. Technical Field

Exemplary aspects of the present invention relate to a fixing device and an image forming apparatus, and more particularly, to a fixing device for fixing an image on a recording medium and an image forming apparatus incorporating the fixing device.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing rotator rotatable in a predetermined direction of rotation and a pressure rotator pressed against an outer circumferential surface of the fixing rotator. A heater is disposed opposite an inner circumferential surface of the fixing rotator to heat the fixing rotator. A reflector is disposed opposite the heater to reflect light radiated from the heater onto the inner circumferential surface of the fixing rotator. A support mounts the reflector. A heater holder is mounted on the support to hold the heater.

This specification further describes an improved image forming apparatus. In one exemplary embodiment, the image forming apparatus includes an image forming device to form a toner image and a fixing device, disposed downstream from the image forming device in a recording medium conveyance direction, to fix the toner image on a recording medium. The fixing device includes a fixing rotator rotatable in a predetermined direction of rotation and a pressure rotator pressed against an outer circumferential surface of the fixing rotator. A heater is disposed opposite an inner circumferential surface of the fixing rotator to heat the fixing rotator. A reflector is disposed opposite the heater to reflect light radiated from the heater onto the inner circumferential surface of the fixing rotator. A support mounts the reflector. A heater holder is mounted on the support to hold the heater.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
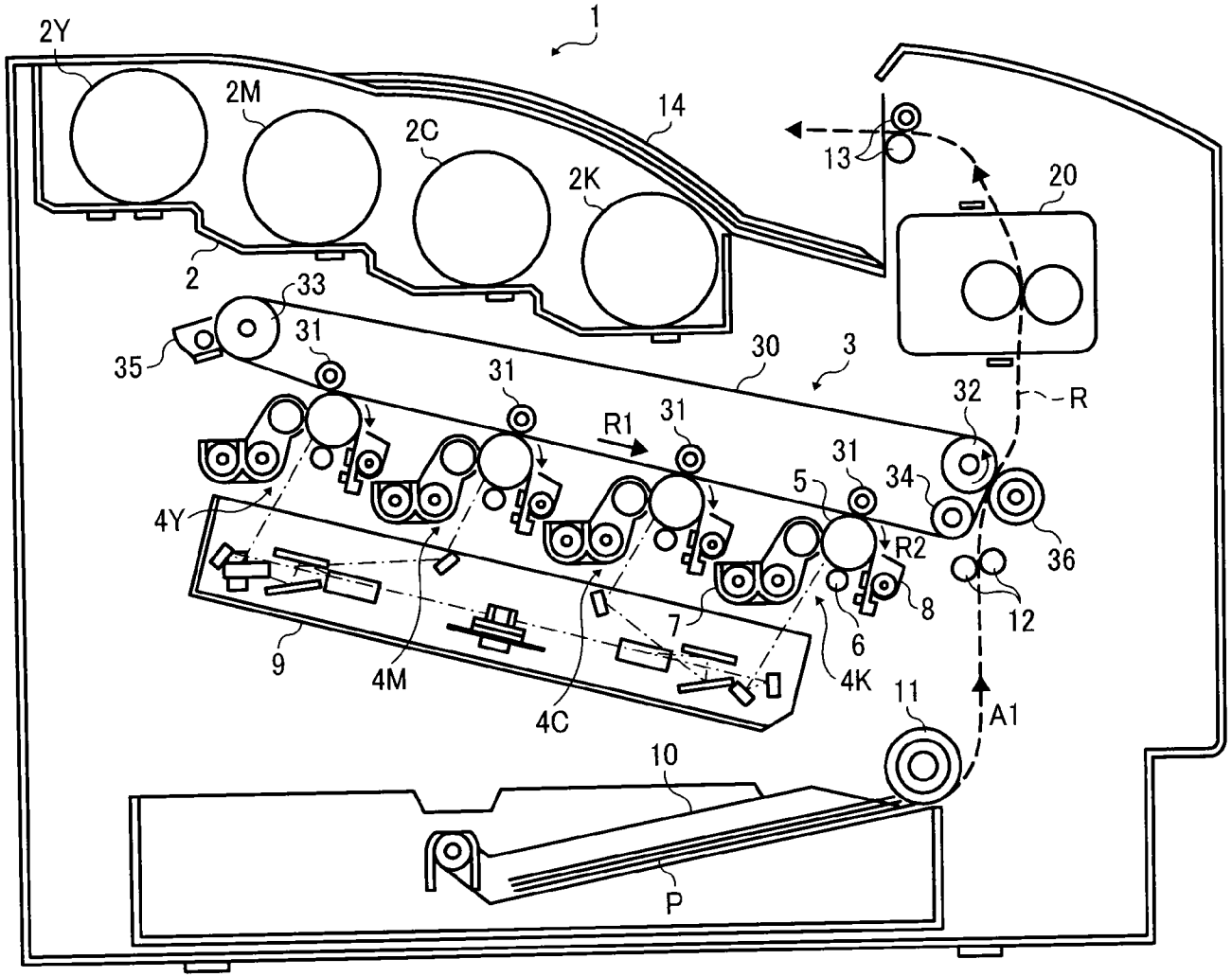
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a tandem color laser printer that forms color and monochrome toner images on recording media by electrophotography.

With reference to FIG. 1, a description is provided of a construction of the image forming apparatus 1.

The image forming apparatus 1 employs a tandem structure in which a plurality of photoconductors is aligned in tandem. Alternatively, the image forming apparatus 1 may employ structures other than the tandem structure.

As shown in FIG. 1, the image forming apparatus 1 includes four image forming devices 4Y, 4M, 4C, and 4K situated in a center portion thereof. Although the image forming devices 4Y, 4M, 4C, and 4K contain yellow, magenta, cyan, and black developers (e.g., toners) that form yellow, magenta, cyan, and black toner images, respectively, resulting in a color toner image, they have an identical structure. Hence, a description is provided of the image forming device 4K that forms a black toner image and a description of the image forming devices 4Y, 4M, and 4C that form yellow, magenta, and cyan toner images, respectively, is omitted. Accordingly, reference numerals are assigned to components incorporated in the image forming device 4K and omitted for components incorporated in each of the image forming devices 4Y, 4M, and 4C.

The image forming device 4K includes a drum-shaped photoconductor 5 serving as an image carrier that bears an electrostatic latent image and a resultant toner image; a charger 6 that charges an outer circumferential surface of the photoconductor 5; a development device 7 that supplies toner to an electrostatic latent image formed on the outer circumferential surface of the photoconductor 5, thus visualizing the electrostatic latent image as a toner image; and a cleaner 8 that cleans the outer circumferential surface of the photoconductor 5.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31 serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 counterclockwise in FIG. 1 in a rotation direction R1 by friction therebetween.

The four primary transfer rollers 31 sandwich the intermediate transfer belt 30 together with the four photoconductors 5, respectively, forming four primary transfer nips between the intermediate transfer belt 30 and the photoconductors 5. The primary transfer rollers 31 are connected to a power supply that applies a predetermined direct current voltage and/or alternating current voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is connected to the power supply that applies a predetermined direct current voltage and/or alternating current voltage thereto.

The belt cleaner 35 includes a cleaning brush and a cleaning blade that contact an outer circumferential surface of the intermediate transfer belt 30. A waste toner conveyance tube extending from the belt cleaner 35 to an inlet of a waste toner container conveys waste toner collected from the intermediate transfer belt 30 by the belt cleaner 35 to the waste toner container.

A bottle holder 2 situated in an upper portion of the image forming apparatus 1 accommodates four toner bottles 2Y, 2M, 2C, and 2K detachably attached thereto to contain and supply fresh yellow, magenta, cyan, and black toners to the development devices 7 of the image forming devices 4Y, 4M, 4C, and 4K, respectively. For example, the fresh yellow, magenta, cyan, and black toners are supplied from the toner bottles 2Y, 2M, 2C, and 2K to the development devices 7 through toner supply tubes interposed between the toner bottles 2Y, 2M, 2C, and 2K and the development devices 7, respectively.

In a lower portion of the image forming apparatus 1 are a paper tray 10 that loads a plurality of recording media P (e.g., sheets) and a feed roller 11 that picks up and feeds a recording medium P from the paper tray 10 toward the secondary transfer nip formed between the secondary transfer roller 36 and the intermediate transfer belt 30. The recording media P may be thick paper, postcards, envelopes, plain paper, thin paper, coated paper, art paper, tracing paper, overhead projector (OHP) transparencies, and the like. Optionally, a bypass tray that loads thick paper, postcards, envelopes, thin paper, coated paper, art paper, tracing paper, OHP transparencies, and the like may be attached to the image forming apparatus 1.

A conveyance path R extends from the feed roller 11 to an output roller pair 13 to convey the recording medium P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a recording medium conveyance direction A1. The registration roller pair 12 serving as a timing roller pair feeds the recording medium P conveyed from the feed roller 11 toward the secondary transfer nip.

The conveyance path R is further provided with a fixing device 20 located above the secondary transfer nip, that is, downstream from the secondary transfer nip in the recording medium conveyance direction A1. The fixing device 20 fixes a toner image transferred from the intermediate transfer belt 30 onto the recording medium P conveyed from the secondary transfer nip on the recording medium P. The conveyance path R is further provided with the output roller pair 13 located above the fixing device 20, that is, downstream from the fixing device 20 in the recording medium conveyance direction A1. The output roller pair 13 discharges the recording medium P bearing the fixed toner image onto the outside of the image forming apparatus 1, that is, an output tray 14 disposed atop the image forming apparatus 1. The output tray 14 stocks the recording medium P discharged by the output roller pair 13.

With reference to FIG. 1, a description is provided of an image forming operation of the image forming apparatus 1 having the structure described above to form a color toner image on a recording medium P.

As a print job starts, a driver drives and rotates the photoconductors 5 of the image forming devices 4Y, 4M, 4C, and 4K, respectively, clockwise in FIG. 1 in a rotation direction R2. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data contained in image data sent from the external device, respectively, thus forming electrostatic latent images thereon. The development devices 7 supply yellow, magenta, cyan, and black toners to the electrostatic latent images formed on the photoconductors 5, visualizing the electrostatic latent images into yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction R1 by friction therebetween. The power supply applies a constant voltage or a constant current control voltage having a polarity opposite a polarity of the charged toner to the primary transfer rollers 31, creating a transfer electric field at each primary transfer nip formed between the photoconductor 5 and the primary transfer roller 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a color toner image is formed on the outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a sheet P from the paper tray 10 toward the registration roller pair 12 in the conveyance path R. The registration roller pair 12 conveys the sheet P sent to the conveyance path R by the feed roller 11 to the secondary transfer nip formed between the secondary transfer roller 36 and the intermediate transfer belt 30 at a proper time. The secondary transfer roller 36 is applied with a transfer voltage having a polarity opposite a polarity of the charged yellow, magenta, cyan, and black toners constituting the color toner image formed on the intermediate transfer belt 30, thus creating a transfer electric field at the secondary transfer nip.

As the yellow, magenta, cyan, and black toner images formed on the intermediate transfer belt 30 reach the secondary transfer nip in accordance with rotation of the intermediate transfer belt 30, the transfer electric field created at the secondary transfer nip secondarily transfers the yellow, magenta, cyan, and black toner images formed on the intermediate transfer belt 30 onto the recording medium P collectively, thus forming a color toner image on the recording medium P. After the secondary transfer of the color toner image from the intermediate transfer belt 30 onto the recording medium P, the belt cleaner 35 removes residual toner failed to be transferred onto the recording medium P and therefore remaining on the intermediate transfer belt 30 therefrom. The removed toner is conveyed and collected into the waste toner container.

Thereafter, the recording medium P bearing the color toner image is conveyed to the fixing device 20 that fixes the color toner image on the recording medium P. Then, the recording medium P bearing the fixed color toner image is discharged by the output roller pair 13 onto the outside of the image forming apparatus 1, that is, the output tray 14 that stocks the recording medium P.

The above describes the image forming operation of the image forming apparatus 1 to form the color toner image on the recording medium P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 2:
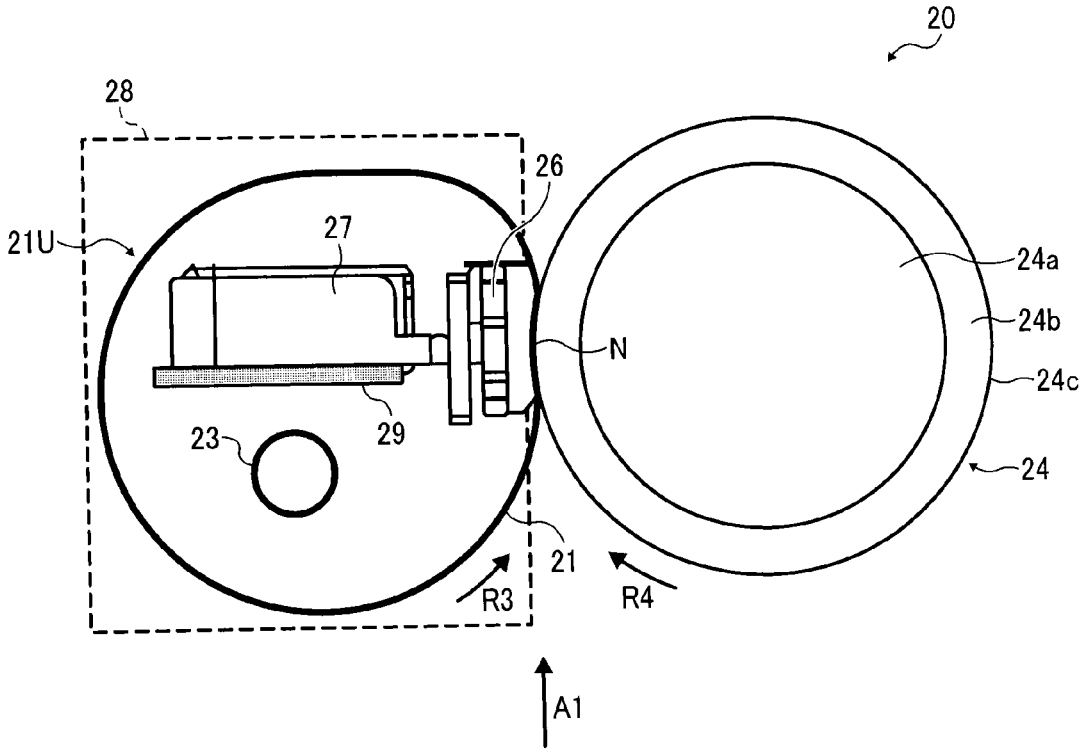
FIG. 2 is a vertical sectional view of a fixing device incorporated in the image forming apparatus shown in FIG. 1.

With reference to FIG. 2, a description is provided of a construction of the fixing device 20 incorporated in the image forming apparatus 1 described above.

FIG. 2 is a vertical sectional view of the fixing device 20. As shown in FIG. 2, the fixing device 20 (e.g., a fuser or a fuser unit) includes a flexible, endless fixing belt 21 serving as a fixing rotator formed into a loop and rotatable in a rotation direction R3; a pressure roller 24 serving as a pressure rotator separably or unseparably contacting an outer circumferential surface of the fixing belt 21 and rotatable in a rotation direction R4; and a nip formation pad 26, a heater 23, a support 27, and a reflector 29 situated inside the loop formed by the fixing belt 21. The heater 23 disposed opposite an inner circumferential surface of the fixing belt 21 heats the fixing belt 21 directly. The fixing belt 21 and the components disposed inside the loop formed by the fixing belt 21, that is, the heater 23, the nip formation pad 26, the support 27, and the reflector 29, may constitute a belt unit 21U separably coupled with the pressure roller 24.

A detailed description is now given of a configuration of the nip formation pad 26.

The nip formation pad 26 situated inside the loop formed by the fixing belt 21 is disposed opposite the pressure roller 24 via the fixing belt 21, forming a fixing nip N between the fixing belt 21 and the pressure roller 24. As the fixing belt 21 rotates in the rotation direction R3, the fixing belt 21 slides over the nip formation pad 26 directly or indirectly via a low-friction sheet. The nip formation pad 26 is made of a heat resistant material. A longitudinal direction of the nip formation pad 26 is parallel to an axial direction of the fixing belt 21 or the pressure roller 24.

The nip formation pad 26 includes a recess disposed opposite the fixing nip N. The recess of the nip formation pad 26 directs a leading edge of the recording medium P toward the pressure roller 24 as the recording medium P is discharged from the fixing nip N, facilitating separation of the recording medium P from the fixing belt 21 and suppressing jamming of the recording medium P.

A detailed description is now given of a construction of the fixing belt 21.

The fixing belt 21 is a thin, flexible endless belt or film made of metal such as nickel and SUS stainless steel or resin such as polyimide. The fixing belt 21 is constructed of a base layer, an elastic layer, and a release layer. The release layer constituting an outer surface layer is made of tetrafluoroethylene-perfluoroalkylvinylether copolymer (PFA), polytetrafluoroethylene (PTFE), or the like to facilitate separation of toner of the toner image on the recording medium P from the fixing belt 21. The elastic layer is sandwiched between the base layer and the release layer and made of silicone rubber or the like. If the fixing belt 21 does not incorporate the elastic layer, the fixing belt 21 has a decreased thermal capacity that improves fixing property of being heated quickly to a predetermined fixing temperature at which the toner image is fixed on the recording medium P. However, as the pressure roller 24 and the fixing belt 21 sandwich and press the toner image on the recording medium P passing through the fixing nip N, slight surface asperities of the fixing belt 21 may be transferred onto the toner image on the recording medium P, resulting in variation in gloss of the solid toner image that may appear as an orange peel image on the recording medium P. To address this circumstance, the elastic layer made of silicone rubber has a thickness not smaller than about 100 micrometers. As the elastic layer deforms, the elastic layer absorbs slight surface asperities of the fixing belt 21.

A detailed description is now given of a configuration of the support 27.

The support 27 (e.g., a stay), situated inside the loop formed by the fixing belt 21, supports the nip formation pad 26. As the nip formation pad 26 receives pressure from the pressure roller 24, the support 27 supports the nip formation pad 26 to prevent bending of the nip formation pad 26 and produce a predetermined nip length in the recording medium conveyance direction A1 throughout the entire width of the fixing belt 21 in the axial direction thereof. The support 27 is made of metal such as stainless steel, iron, aluminum, or the like. Each lateral end of the support 27 in a longitudinal direction thereof parallel to the axial direction of the fixing belt 21 is mounted on a holder incorporating a flange, a side plate frame 28, or the like. Thus, the support 27 is secured at a predetermined position inside the fixing device 20.

A detailed description is now given of a configuration of the reflector 29.

The reflector 29 (e.g., a reflection plate) is mounted on an opposed face of the support 27 disposed opposite the heater 23. The reflector 29 reflects light radiated from the heater 23 to the support 27 toward the inner circumferential surface of the fixing belt 21, preventing the support 27 from being heated unnecessarily by the heater 23 and thereby suppressing waste of energy. Alternatively, instead of the reflector 29, the opposed face of the support 27 disposed opposite the heater 23 may be treated with insulation or mirror finish to reflect light radiated from the heater 23 to the support 27 toward the fixing belt 21. According to this exemplary embodiment, the reflector 29 includes an aluminum base having a surface treated with silver-vapor-deposition. The reflector 29 may be made of a material other than aluminum and silver. However, silver having a decreased emissivity reflects light radiated from the heater 23 to the support 27 toward the fixing belt 21, allowing the fixing belt 21 to absorb heat from the heater 23 effectively. The heater 23 may be a halogen heater, an induction heater, a resistance heat generator, a carbon heater, or the like.

A detailed description is now given of a construction of the pressure roller 24.

The pressure roller 24 is constructed of a metal core 24*a*, an elastic layer 24*b* coating the metal core 24*a* and made of rubber, and a surface release layer 24*c* coating the elastic layer 24*b* and made of PFA or PTFE to facilitate separation of the recording medium P from the pressure roller 24. As a driving force generated by a driver (e.g., a motor) situated inside the image forming apparatus 1 depicted in FIG. 1 is transmitted to the pressure roller 24 through a gear train, the pressure roller 24 rotates in the rotation direction R4. A spring presses the pressure roller 24 against the nip formation pad 26 via the fixing belt 21. The pressure roller 24 may be a hollow roller or a solid roller. If the pressure roller 24 is a hollow roller, a heater such as a halogen heater may be disposed inside the hollow roller. The elastic layer 24*b* may be made of solid rubber. Alternatively, if no heater is situated inside the pressure roller 24, the elastic layer 24*b* may be made of sponge rubber. The sponge rubber is more preferable than the solid rubber because it has an increased insulation that draws less heat from the fixing belt 21.

As the pressure roller 24 rotates in the rotation direction R4, the fixing belt 21 rotates in the rotation direction R3 in accordance with rotation of the pressure roller 24 by friction therebetween. For example, as the driving force generated by the driver drives and rotates the pressure roller 24 as described above, the driving force is transmitted from the pressure roller 24 to the fixing belt 21 at the fixing nip N, rotating the fixing belt 21 in the rotation direction R3. At the fixing nip N, the fixing belt 21 rotates as it is sandwiched between the pressure roller 24 and the nip formation pad 26; at a circumferential span of the fixing belt 21 other than the fixing nip N, the fixing belt 21 rotates as it is guided by the flange of the side plate frame 28 at each lateral end of the fixing belt 21 in the axial direction thereof.

A description is provided of heating of the fixing belt 21.

Figure 3:
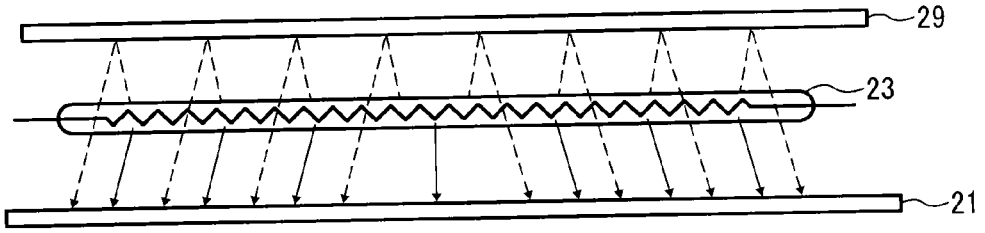
FIG. 3 is a horizontal sectional view of a fixing belt, a heater, and a reflector incorporated in the fixing device shown in FIG. 2.

FIG. 3 is a horizontal sectional view of the fixing belt 21, the heater 23, and the reflector 29. As shown in FIG. 3, the heater 23 heats the fixing belt 21 directly and indirectly. For example, light radiated from the heater 23 irradiates the fixing belt 21 directly as illustrated in the solid line and indirectly through the reflector 29 that reflects light from the heater 23 onto the fixing belt 21 as illustrated in the dotted line. Thus, the heater 23 heats the fixing belt 21 effectively by direct and indirect heating.

Since the heater 23 heats the fixing belt 21 directly, the fixing belt 21 is heated quickly, shortening a first print time taken to output the recording medium P bearing the fixed toner image upon receipt of a print job through preparation for a print operation and the subsequent print operation and therefore saving energy. However, the reflector 29 and the heater 23 may be supported by separate holders mounted on a unit structure, respectively. Accordingly, an increased number of parts is used to position the reflector 29 with respect to the heater 23, fluctuating positional relation therebetween and reflection efficiency of the reflector 29 as described below.

Figure 4A:
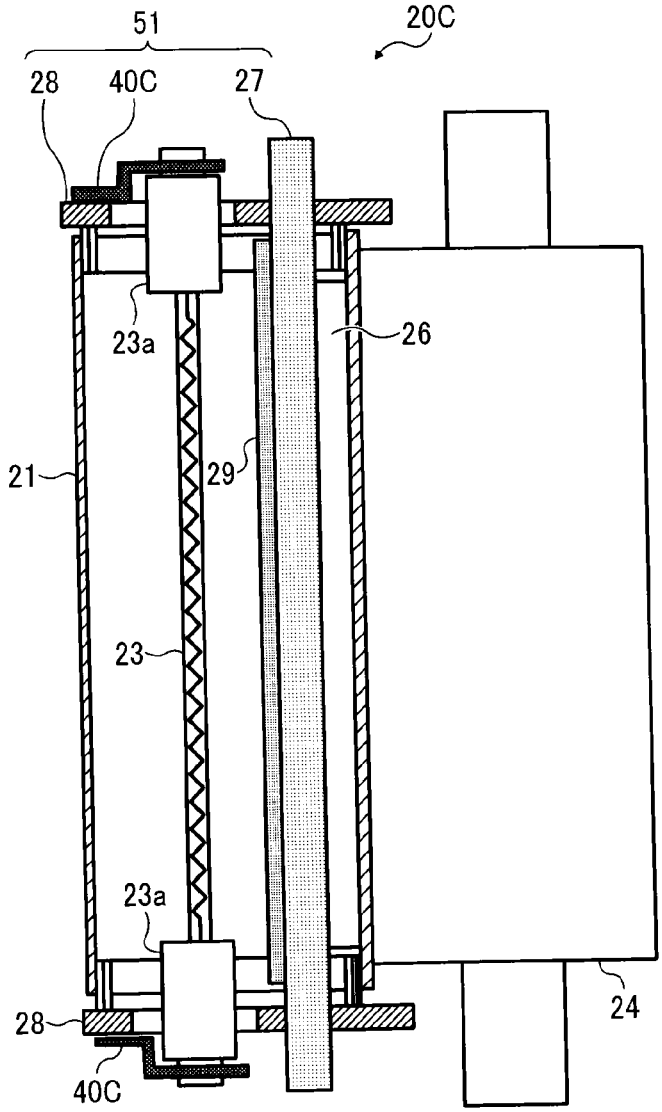
FIG. 4A is a horizontal sectional view of a comparative fixing device.
Figure 4B:
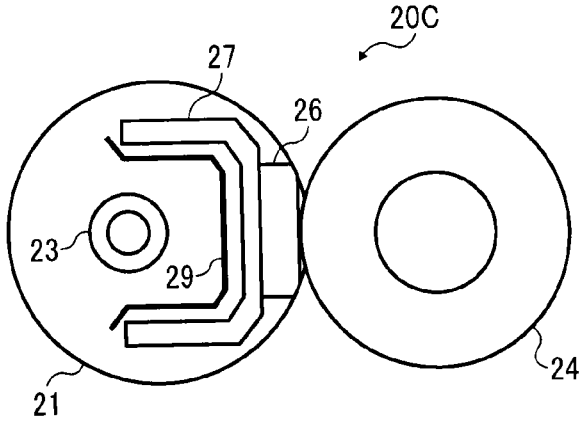
FIG. 4B is a vertical sectional view of the fixing device shown in FIG. 4A.

With reference to FIGS. 4A and 4B, a description is provided of holding of the heater 23.

FIG. 4A is a horizontal sectional view of a comparative fixing device 20C incorporating a comparative holder 51. FIG. 4B is a vertical sectional view of the comparative fixing device 20C. As shown in FIG. 4A, the comparative holder 51 includes the support 27, the side plate frame 28, and a comparative heater holder 40C. The comparative heater holder 40C (e.g., a sheet metal) is attached to the side plate frame 28 serving as a unit structure. The comparative heater holder 40C contacts and supports a heater base 23*a* of the heater 23 that is disposed at each lateral end of the heater 23 in a longitudinal direction thereof parallel to the axial direction of the fixing belt 21. On the other hand, the support 27 supporting the nip formation pad 26 mounts the reflector 29. The support 27 is attached to the side plate frame 28. Accordingly, three components, that is, the support 27, the side plate frame 28, and the comparative heater holder 40C, are interposed between the reflector 29 and the heater 23. Consequently, the reflector 29 and the heater 23 are susceptible to fluctuation in positional relation therebetween due to dimensional error and installation error of the support 27, the side plate frame 28, and the comparative heater holder 40C.

Figure 5A:
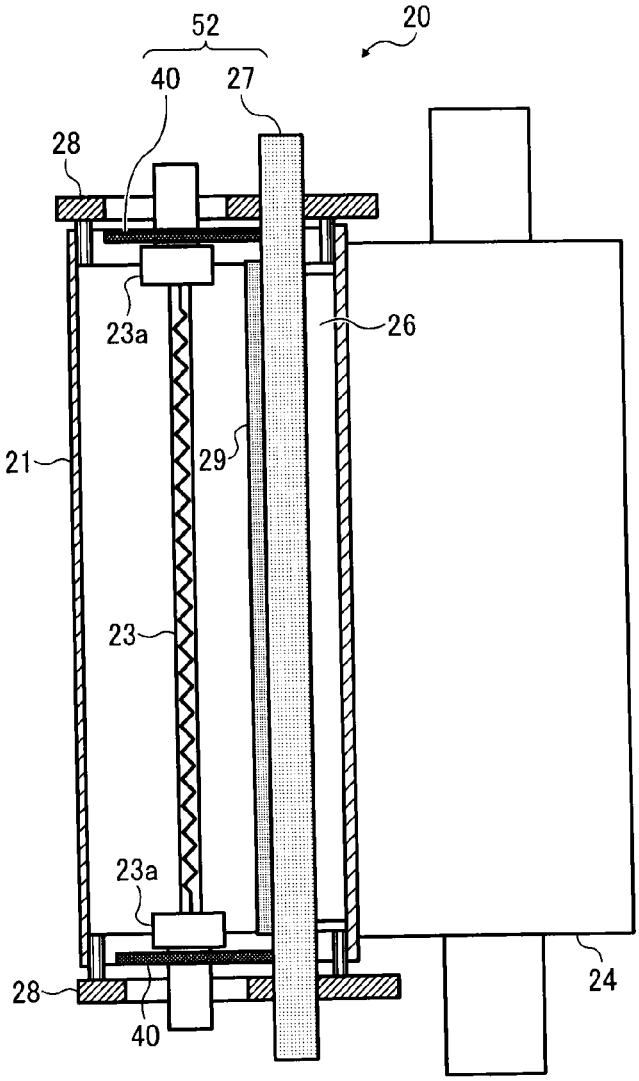
FIG. 5A is a horizontal sectional view of the fixing device shown in FIG. 2 illustrating a heater holder incorporated therein.
Figure 5B:
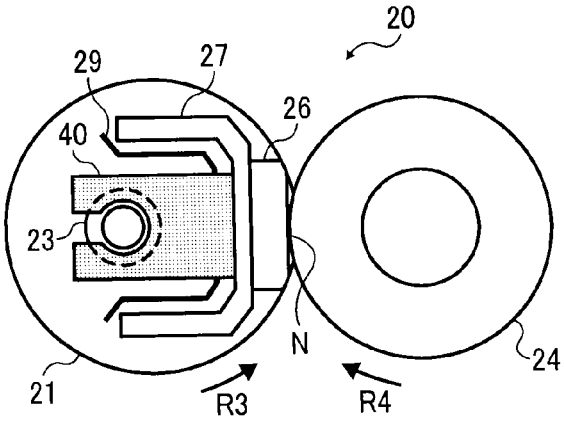
FIG. 5B is a vertical sectional view of the fixing device shown in FIG. 5A.

To address this circumstance, the fixing device 20 includes a holder 52 as shown in FIGS. 5A and 5B. FIG. 5A is a horizontal sectional view of the fixing device 20 incorporating the holder 52. FIG. 5B is a vertical sectional view of the fixing device 20. As shown in FIG. 5A, the holder 52 includes the support 27 and a heater holder 40. The heater holder 40 holding the heater base 23*a* of the heater 23 is disposed at each lateral end of the heater 23 in the longitudinal direction thereof parallel to the axial direction of the fixing belt 21. The heater holder 40 is mounted on the support 27 mounting the reflector 29. The support 27 being attached with the heater holder 40 and supporting the reflector 29 is attached to the side plate frame 28. Unlike the comparative heater holder 40C depicted in FIG. 4A, the heater holder 40 shown in FIG. 5A is not mounted on the side plate frame 28. Accordingly, the reflector 29 mounted on the support 27 is positioned with respect to the heater 23 held by the heater holder 40 mounted on the support 27, not through the side plate frame 28, reducing fluctuation in positional relation between the heater 23 and the reflector 29.

Alternatively, the support 27 may be contoured to contact and support the heater 23 to reduce the number of parts or may be molded with the heater holder 40 to further reduce fluctuation in positional relation between the heater 23 and the reflector 29. Yet alternatively, the side plate frame 28, the reflector 29, and the heater 23 may be manufactured into a unit or a module. On the other hand, if it is difficult to mold the support 27 with the heater holder 40 or if the support 27 molded with the heater holder 40 is not installed inside the loop formed by the fixing belt 21 or the fixing device 20 readily, the support 27 may be manufactured separately from the heater holder 40.

With reference to FIGS. 6 to 9, a description is provided of variations of the heater holder 40 shown in FIG. 5B that improve precision in positional relation between the heater 23 and the reflector 29.

First, a first variation of the heater holder 40 is described with reference to FIG. 6.

Figure 6:
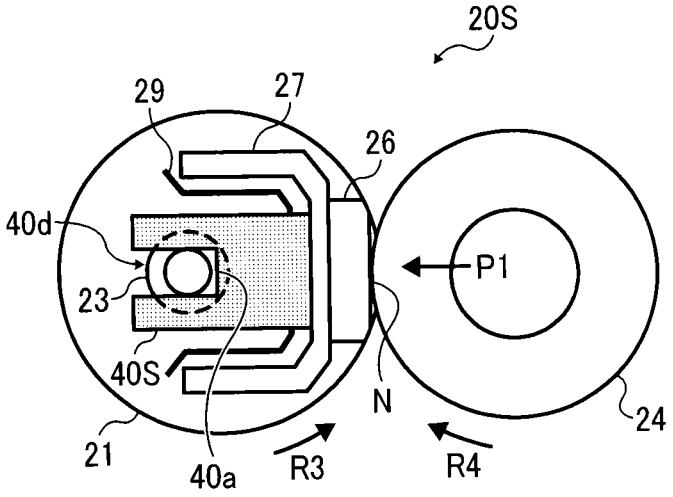
FIG. 6 is a vertical sectional view of a fixing device incorporating a heater holder as a first variation of the heater holder shown in FIG. 5B.

FIG. 6 is a vertical sectional view of a fixing device 20S incorporating a heater holder 40S as the first variation of the heater holder 40 depicted in FIG. 5B. The heater holder 40 mounted simply on the support 27 as shown in FIG. 5A may contact the heater base 23*a* of the heater 23 loosely, producing rattling therebetween. For example, a heater insulator constituting the heater base 23*a* provides increased tolerance as it is manufactured as a product. Accordingly, as the heater base 23*a* is mounted on the heater holder 40, rattling may occur between the heater base 23*a* and the heater holder 40. Consequently, positional relation between the heater 23 and the reflector 29 may fluctuate in accordance with rattling between the heater base 23*a* and the heater holder 40. To address this circumstance, as shown in FIG. 6, the heater holder 40S includes a rectangular notch 40*d* to engage the heater 23. The notch 40*d* includes an abutment portion 40*a* extending in a direction orthogonal to a pressurization direction P1 in which the pressure roller 24 exerts pressure to the support 27 via the fixing belt 21 and the nip formation pad 26. The heater 23 is disposed opposite the support 27 via the abutment portion 40*a* of the heater holder 40S.

Figure 7A:
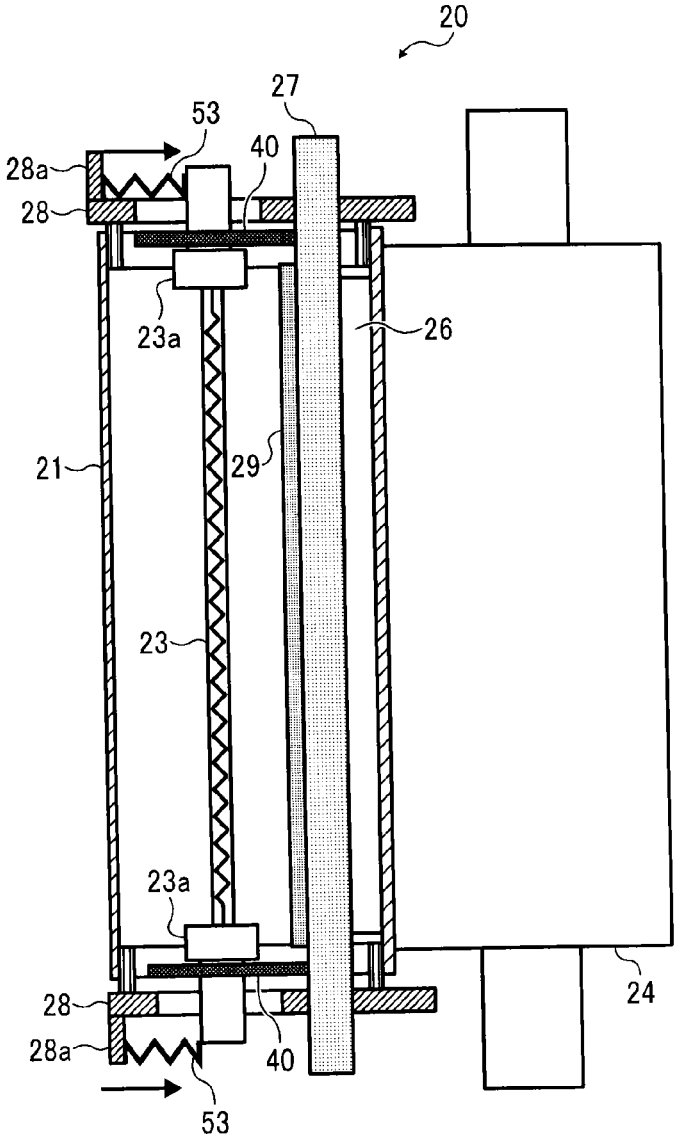
FIG. 7A is a horizontal sectional view of the fixing device shown in FIG. 5A illustrating a compression spring incorporated therein.
Figure 7B:
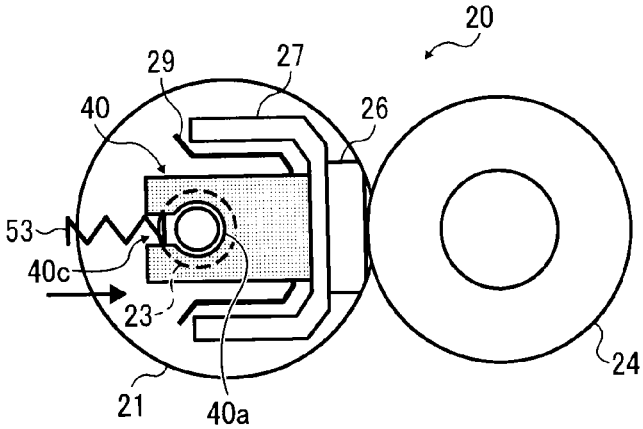
FIG. 7B is a vertical sectional view of the fixing device shown in FIG. 7A.

With reference to FIGS. 7A and 7B, a description is provided of one example of a biasing member that presses the heater 23 against the abutment portion 40*a* of the heater holder 40.

FIG. 7A is a horizontal sectional view of the fixing device 20 illustrating a compression spring 53 as a biasing member. FIG. 7B is a vertical sectional view of the fixing device 20 illustrating the compression spring 53. As shown in FIG. 7A, the compression spring 53 serving as a biasing member is anchored to the heater 23 and a wing 28*a* of the side plate frame 28. For example, the wing 28*a* is manufactured by bending a sheet metal of the side plate frame 28 or by being attached to the side plate frame 28. As shown in FIG. 7B, the compression spring 53 biases the heater 23 against the abutment portion 40*a* of the heater holder 40 to adjust a distance (e.g., a gap) between the heater 23 and the reflector 29 to be smaller than a predetermined value.

Figure 8A:
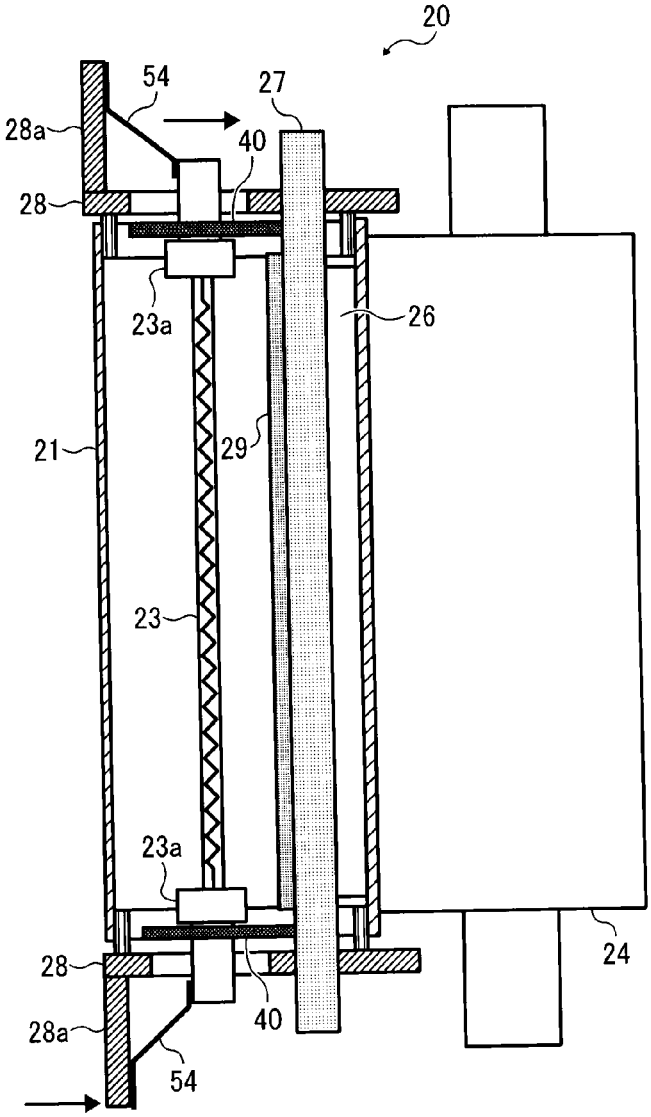
FIG. 8A is a horizontal sectional view of the fixing device shown in FIG. 5A illustrating a plate spring incorporated therein.
Figure 8B:
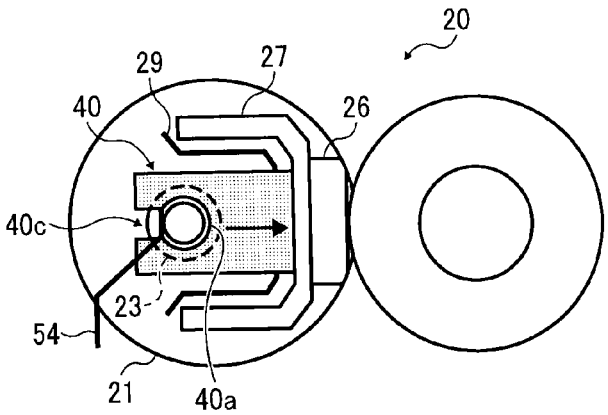
FIG. 8B is a vertical sectional view of the fixing device shown in FIG. 8A.

With reference to FIGS. 8A and 8B, a description is provided of another example of the biasing member that presses the heater 23 against the abutment portion 40*a* of the heater holder 40.

FIG. 8A is a horizontal sectional view of the fixing device 20 illustrating a plate spring 54 as a biasing member. FIG. 8B is a vertical sectional view of the fixing device 20 illustrating the plate spring 54. As shown in FIG. 8A, the plate spring 54 serving as a biasing member is anchored to the heater 23 and the wing 28*a* of the side plate frame 28. As shown in FIG. 8B, the plate spring 54 biases the heater 23 against the abutment portion 40*a* of the heater holder 40 to adjust a distance (e.g., a gap) between the heater 23 and the reflector 29 to be smaller than a predetermined value.

FIGS. 7B and 8B illustrate the heater holder 40 including a notch 40*c* substantially circular in cross-section. Alternatively, the compression spring 53 and the plate spring 54 are also installable in the fixing device 20S depicted in FIG. 6 that incorporates the heater holder 40S having the rectangular notch 40*d*.

Next, a second variation of the heater holder 40 is described with reference to FIG. 9.

Figure 9:
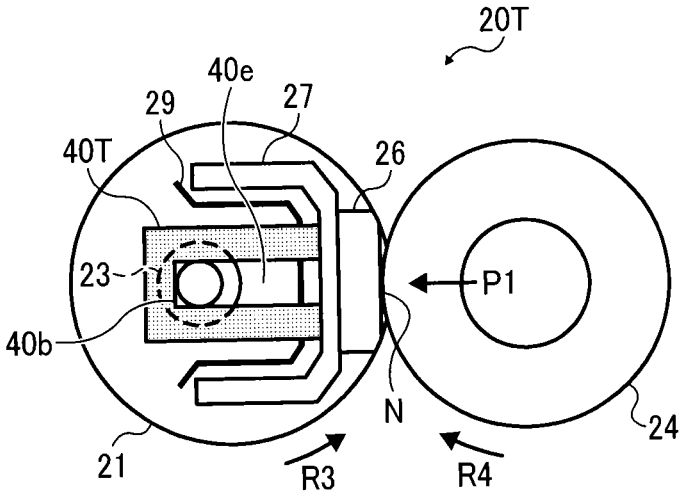
FIG. 9 is a vertical sectional view of a fixing device incorporating a heater holder as a second variation of the heater holder shown in FIG. 5B.

FIG. 9 is a vertical sectional view of a fixing device 20T incorporating a heater holder 40T as the second variation of the heater holder 40 depicted in FIG. 5B. As shown in FIG. 9, the heater holder 40T includes a rectangular notch 40*e* to engage the heater 23. The notch 40*e* includes an abutment portion 40*b* extending in the direction orthogonal to the pressurization direction P1 in which the pressure roller 24 exerts pressure to the support 27 via the fixing belt 21 and the nip formation pad 26. The heater 23 is interposed between the abutment portion 40*b* of the heater holder 40T and the support 27. A biasing member (e.g., an extension spring and a tension spring) biases the heater 23 against the abutment portion 40*b* of the heater holder 40T to adjust a distance (e.g., a gap) between the heater 23 and the reflector 29 to be greater than the predetermined value. Alternatively, the notch 40*e* may be substantially circular in cross-section like the notch 40*c* depicted in FIG. 7B.

A description is provided of advantages of the fixing devices 20, 20S, and 20T.

As shown in FIGS. 5B, 6, and 9, the fixing devices 20, 20S, and 20T include the fixing belt 21 serving as a fixing rotator formed into a loop and rotatable in the rotation direction R3; the pressure roller 24 serving as a pressure rotator contacting the outer circumferential surface of the fixing belt 21; the nip formation pad 26 disposed opposite the inner circumferential surface of the fixing belt 21 and disposed opposite the pressure roller 24 via the fixing belt 21 to form the fixing nip N between the fixing belt 21 and the pressure roller 24; the heater 23 disposed opposite the inner circumferential surface of the fixing belt 21 to heat the fixing belt 21; the support 27 to support the nip formation pad 26 against pressure from the pressure roller 24; the reflector 29, supported by the support 27, to reflect light radiated from the heater 23 to the fixing belt 21; and a heater holder (e.g., the heater holders 40, 40S, and 40T), mounted on the support 27, to hold the heater 23.

Since the heater holder is mounted on the support 27 that supports the nip formation pad 26 and mounts the reflector 29, the reflector 29 is positioned with respect to the heater 23 through a simple structure, reducing the number of parts that position the reflector 29 relative to the heater 23 and improving precision in positional relation between the heater 23 and the reflector 29.

According to the exemplary embodiments described above, the fixing belt 21 serves as a fixing rotator. Alternatively, a fixing roller, a fixing film, a fixing sleeve, or the like may be used as a fixing rotator. Further, the pressure roller 24 serves as a pressure rotator. Alternatively, a pressure belt or the like may be used as a pressure rotator.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotator rotatable in a predetermined direction of rotation;

a pressure rotator pressed against an outer circumferential surface of the fixing rotator;

a heater, disposed opposite an inner circumferential surface of the fixing rotator, to heat the fixing rotator;

a reflector, disposed opposite the heater, to reflect light radiated from the heater onto the inner circumferential surface of the fixing rotator;

a support mounting the reflector;

a heater holder, mounted on the support at a position inboard from a lateral end of the support, to directly contact and hold the heater; and a biasing member to bias the heater against the heater holder, wherein the heater holder includes an abutment portion to abut the heater biased by the biasing member.

2. The fixing device according to claim 1, wherein the support is molded with the heater holder.

3. The fixing device according to claim 1, wherein the support is separately provided from the heater holder.

4. The fixing device according to claim 1, wherein the biasing member includes one of a compression spring, a plate spring, and an extension spring.

5. The fixing device according to claim 1, wherein the heater is interposed between the abutment portion of the heater holder and the support, and wherein the biasing member biases the heater against the abutment portion of the heater holder to adjust a distance between the heater and the reflector mounted on the support to be greater than a predetermined value.

6. The fixing device according to claim 1, wherein the heater is disposed opposite the support via the abutment portion of the heater holder, and wherein the biasing member biases the heater against the abutment portion of the heater holder to adjust a distance between the heater and the reflector mounted on the support to be smaller than a predetermined value.

7. The fixing device according to claim 1, wherein the abutment portion of the heater holder extends in a direction orthogonal to a pressurization direction in which the pressure rotator exerts pressure to the fixing rotator.

8. The fixing device according to claim 1, wherein the heater holder further includes a notch defined by the abutment portion.

9. The fixing device according to claim 1, further comprising a nip formation pad disposed opposite the pressure rotator via the fixing rotator to form a fixing nip between the fixing rotator and the pressure rotator, the nip formation pad supported by the support.

10. The fixing device according to claim 1, further comprising a side plate frame mounting the support.

11. The fixing device according to claim 1, wherein the support includes a stay.

12. The fixing device according to claim 1, wherein the fixing rotator includes a fixing belt.

13. The fixing device according to claim 1, wherein the pressure rotator includes a pressure roller.

14. An image forming apparatus comprising:

an image forming device to form a toner image; and a fixing device, disposed downstream from the image forming device in a recording medium conveyance direction, to fix the toner image on a recording medium, the fixing device including:

a fixing rotator rotatable in a predetermined direction of rotation;

a pressure rotator pressed against an outer circumferential surface of the fixing rotator;

a heater, disposed opposite an inner circumferential surface of the fixing rotator, to heat the fixing rotator;

a reflector, disposed opposite the heater, to reflect light radiated from the heater onto the inner circumferential surface of the fixing rotator;

a support mounting the reflector;

a heater holder, mounted on the support at a position inboard from a lateral end of the support, to directly contact and hold the heater; and a biasing member to bias the heater against the heater holder, wherein the heater holder includes an abutment portion to abut the heater biased by the biasing member.

15. A fixing device comprising:

a fixing rotator rotatable in a predetermined direction of rotation;

a pressure rotator pressed against an outer circumferential surface of the fixing rotator;

a heater, disposed opposite an inner circumferential surface of the fixing rotator, to heat the fixing rotator;

a reflector, disposed opposite the heater, to reflect light radiated from the heater onto the inner circumferential surface of the fixing rotator;

a support mounting the reflector;

a heater holder, mounted on the support, to hold the heater; and a biasing member to bias the heater against the heater holder, wherein the heater holder includes an abutment portion to abut the heater biased by the biasing member, the heater is interposed between the abutment portion of the heater holder and the support, and the biasing member biases the heater against the abutment portion of the heater holder to adjust a distance between the heater and the reflector mounted on the support to be greater than a predetermined value.

* * * * *